US009692110B2

(12) United States Patent
Salsbury

(10) Patent No.: US 9,692,110 B2
(45) Date of Patent: Jun. 27, 2017

(54) MOTOR VEHICLE ANTENNA ASSEMBLY

(71) Applicant: Ford Global Technologies, LLC, Dearborn, MI (US)

(72) Inventor: Ian Salsbury, Wickford Essex (GB)

(73) Assignee: Ford Global Technologies, LLC, Dearborn, MI (US)

( * ) Notice: Subject to any disclaimer, the term of this patent is extended or adjusted under 35 U.S.C. 154(b) by 208 days.

(21) Appl. No.: 14/293,891

(22) Filed: Jun. 2, 2014

(65) Prior Publication Data

US 2014/0354493 A1 Dec. 4, 2014

(30) Foreign Application Priority Data

Jun. 4, 2013 (GB) ..... 1309957.7

(51) Int. Cl.
*H01Q 1/32* (2006.01)

(52) U.S. Cl.
CPC ..... *H01Q 1/3275* (2013.01)

(58) Field of Classification Search
CPC ..... H01Q 1/3275
USPC ..... 343/711–714
See application file for complete search history.

(56) References Cited

U.S. PATENT DOCUMENTS 3,896,448 A 7/1975 Killen et al.
4,370,658 A 1/1983 Hill
5,568,157 A * 10/1996 Anderson ..... H01Q 1/3275 343/713
6,172,651 B1 * 1/2001 Du ..... H01Q 1/125 333/109
6,204,820 B1 * 3/2001 Jensen, Jr. ..... H01Q 1/005 296/180.1
6,999,033 B2 2/2006 Kordass et al.
7,609,215 B2 * 10/2009 Apostolos ..... H01Q 19/30 343/711
7,671,812 B1 * 3/2010 Yasin ..... H01Q 1/005 343/715
8,228,253 B2 * 7/2012 Berejik ..... H01Q 1/185 343/713

(Continued)

FOREIGN PATENT DOCUMENTS

DE 10157636 A1 6/2003
DE 102007050110 A1 4/2009

(Continued)

OTHER PUBLICATIONS

"What is Overmolding?", Design-Tek blog, Oct. 26, 2013.*

(Continued)

*Primary Examiner* — Huedung Mancuso
(74) *Attorney, Agent, or Firm* — Frank A. McKenzie; Brooks Kushman P.C.

(57) ABSTRACT

An antenna assembly is disclosed in which at least part of the antenna assembly is formed as an integral part of an external plastic roof panel of a motor vehicle. In one embodiment a base member is formed as an integral part of the plastic panel, the base member being used to connect a flexible antenna to a circuit of the motor vehicle by means of an electrical connector. In a second embodiment the antenna is formed as an integral part of a base member. In both cases no aperture is required in the respective plastic panel and so no potential water leak paths are produced.

7 Claims, 2 Drawing Sheets

(56) References Cited

U.S. PATENT DOCUMENTS

| | | | | |
|---|---|---|---|---|
| 8,248,315 | B2 * | 8/2012 | Lindackers | H01Q 1/1207 343/705 |
| 2004/0217906 | A1 * | 11/2004 | Ishibayashi | H01Q 1/1271 343/713 |
| 2005/0077757 | A1 * | 4/2005 | Schonauer | B60J 7/0015 296/215 |
| 2005/0280581 | A1 * | 12/2005 | Poe | H01Q 1/38 343/700 MS |
| 2006/0061145 | A1 * | 3/2006 | Strebe | B62D 65/06 296/214 |
| 2006/0103580 | A1 | 5/2006 | Aichholzer et al. | |
| 2007/0040416 | A1 * | 2/2007 | Bordeaux | B29C 45/14434 296/216.09 |
| 2009/0066593 | A1 * | 3/2009 | Jared | H01Q 1/1214 343/713 |
| 2013/0229315 | A1 * | 9/2013 | Duzdar | H01Q 1/3275 343/713 |
| 2014/0292593 | A1 * | 10/2014 | Thiam | H01Q 1/3275 343/713 |

FOREIGN PATENT DOCUMENTS

| | | | |
|---|---|---|---|
| DE | 102009054009 | A1 | 6/2010 |
| GB | 525720 | A | 9/1940 |
| WO | 0142051 | A1 | 6/2001 |
| WO | 2007051497 | A1 | 5/2007 |
| WO | 2007076499 | A1 | 7/2007 |

OTHER PUBLICATIONS

Intellectual Property Office, Search Report for the corresponding GB Patent Application No. 1309957.7 mailed Aug. 21, 2013.

* cited by examiner

MOTOR VEHICLE ANTENNA ASSEMBLY

CROSS-REFERENCE TO RELATED APPLICATIONS

This application claims foreign priority benefits under 35 U.S.C. §119(a)-(d) to GB 1 309 957.7 filed Jun. 4, 2013, which is hereby incorporated by reference in its entirety.

TECHNICAL FIELD

This invention relates to a motor vehicle and in particular to the fitment of an antenna to a motor vehicle.

BACKGROUND

It is well known to provide a motor vehicle with an antenna to assist with the receiving and/or transmitting of electrical signals such as broadcast radio signals and mobile telephone transmissions.

It is known from, for example U.S. Pat. No. 6,999,033 to provide an antenna assembly for mounting an antenna on a roof panel of a motor vehicle. The assembly has a base body made of metal with a threaded projection passing through a hole in the roof panel. A plastic housing is used to house components of the antenna and a seal is provided between the base body and the roof panel to form a seal between the base body and the roof panel.

It is further known from German Patent Publication DE102007050110 to provide a mounting for an antenna that includes a snap lock fastening that snaps into an aperture in a body panel.

Both of these prior art disclosures suffer from the disadvantage that a possible water leak path is provided via the aperture in the panel to which they are attached if the seal is defective or fails in use due to deterioration or due to irregularities in or distortion of the panel in the region of the aperture.

SUMMARY

It is an object of the invention to provide an improved antenna assembly for a motor vehicle.

According to a first aspect of the invention there is provided a motor vehicle antenna assembly comprising a base member formed as an integral part of a motor vehicle external plastic roof panel and an antenna operatively supported by the base member, first and second connection means are formed as integral parts of the base member, the first connection means providing a connection between the base member and a component requiring use of the antenna and the second connection means providing an electrical connection to the antenna.

The first connection means may be an electrical connector for connection to an electrical circuit of the motor vehicle used to electrically connect the base member to the component requiring use of the antenna.

The first connection may be connected directly to the second connection means via a connection including one of more conductors.

An electronic module may be formed as an integral part of the base member and the electronic module is connected to both the first connection means and the second connection means.

The second connection means may be an electrical connector used to electrically connect the antenna to the base member.

The second connector may provide both a mechanical and an electrical connection to the antenna.

The second connection means may be an electrical conductor and the antenna is formed with the second connection means as part of the base member.

The second connection means may connect the antenna to the electronic module.

According to a second aspect of the invention there is provided a motor vehicle exterior plastic roof panel having an antenna assembly constructed in accordance with said first aspect of the invention.

According to a third aspect of the invention there is provided a motor vehicle having an exterior plastic roof panel constructed in accordance with said second aspect of the invention.

The invention has the advantage that no assembly of the antenna support to the motor vehicle is required. It will be appreciated that fitting a conventional antenna support requires holding the antenna support in position on an outer side of the roof panel while it is secured from an inner side of the roof panel. Furthermore no leak path is present if the support for the antenna is molded as part of the roof panel.

The invention will now be described by way of example with reference to the accompanying drawing of which:

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

The figures are exemplary in nature, are not necessarily drawn to scale, and do not necessarily show production ready components.

Figure 1A:
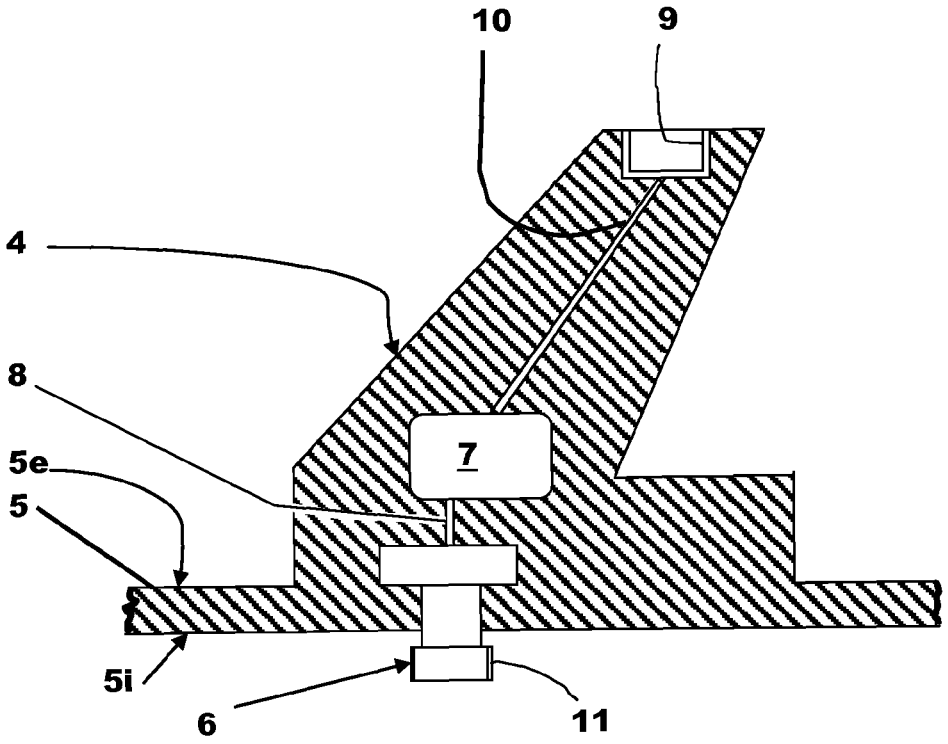
FIG. 1A is a cross-section through a first embodiment of a motor vehicle panel having an integrally formed base member forming one part of an antenna assembly.
Figure 1B:
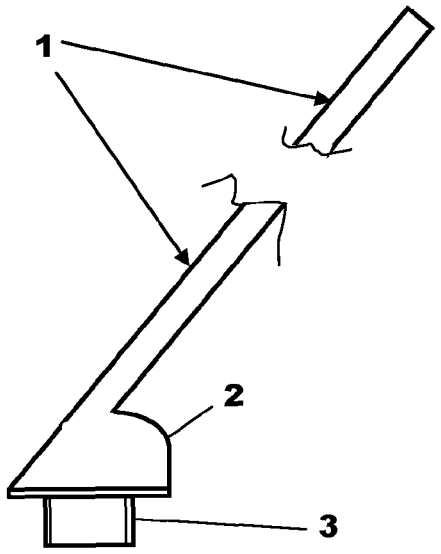
FIG. 1B is a side view of a whip antenna for use with the base member shown in FIG. 1A.

With reference to FIGS. 1A and 1B there is shown a motor vehicle exterior plastic roof panel 5. The plastic roof panel 5 has an upper or exterior surface 5*e* and a lower or interior surface 5*i* facing towards a passenger compartment of a motor vehicle of which the plastic roof panel 5 forms a part. It will be appreciated that an interior trim panel (not shown) will overlie the interior surface 5*i* in use.

A support for an antenna 1 in the form of a base member 4 of an antenna assembly is formed as an integral part of the plastic roof panel 5 from the same plastic material used to make the plastic roof panel 5.

The base member 4 includes first and second integrally molded electrical connection means 6 and 9. The antenna assembly includes the base member 4, the first and second integrally molded electrical connection means 6 and 9 and the antenna 1.

The first electrical connection means is an electrical connector 6 in the form of an integral metal insert having a threaded end portion 11 for connection to an electrical cable forming a part of an electrical circuit of the motor vehicle so as to provide an electrical connection to an electronic component or apparatus (not shown) requiring use of an antenna such as the antenna 1 shown in FIG. 1B.

The second electrical connection means is an electrical connector 9 in the form of an integral metal insert having an internal thread for cooperation with a threaded connector 3 formed by a metal insert in a base portion 2 of the antenna 1. The electrical connector 9 forms not only an electrical connection to the antenna but also is used to mechanically connect the aerial 1 to the base member 4. It will be appreciated that the electrical and mechanical connections could be separate and that the invention is not limited to the use of a single combined connector.

It will be appreciated that the first and second electrical connectors 6 and 9 could be of an alternative type and are not limited to a threaded construction, for example, they could be bayonet or twist lock connectors and, in addition, a different type of connection could be used for each connector 6, 9. That is to say, the first connector 6 could be a threaded connector and the second connector could be a bayonet connector or vice-versa.

An electronic module 7 for the antenna 1 is also formed integrally with the base member 4. The electronic module 7 is in the form of electronic signal processing components such as a filter and/or receiver used for ensuring that the correct frequency signals are communicated via the electrical lead or cable used to connect the antenna 1 to the apparatus requiring its use. If required, thermal insulation could be provided for the electronic module 7 to protect temperature sensitive components of the electronic module 7 during molding of the plastic roof panel 5.

The first and second electrical connectors 6 and 9 and the electronic module 7 are operatively interconnected via electrical connections 8, 10 formed as part of the base member 4. Each electrical connection 8, 10 may include one or more conductors made from a highly conductive material such as a high conductivity metal. When several conductors are used each conductor may be coated with an electrical insulating material to insulate it from other conductors. The electrical connections 8, 10 are overmolded with the plastic material forming the base member 4 along with other components 6, 7, 9 of the base member 4 when the plastic roof panel 5 is formed. A process sometimes referred to as 'insert molding' could be used to embed the components 6, 7, 8, 9 and 10 in the plastic of the base member 4.

It will be appreciated that the first and second electrical connectors 6 and 9 and the electronic module 7 can be operatively connected to the electrical connections 8, 10 to form a sub-assembly that is then overmolded with the plastic forming the base member 4. This will allow the sub-assembly to be tested prior to molding thereby reducing the risk of a faulty connection or component being present in the final base member 4.

In use, an electrical lead (not shown) having a female threaded end connector is threadingly engaged with the threaded portion 11 of the first electrical connector 6 to connect the antenna 1 to the electronic component or apparatus (not shown) requiring use of the antenna and the antenna is attached to the base member 4 by screwing the threaded connector 3 into the second electrical connector 9 to form an electrical and mechanical connection therebetween.

Therefore an electrical connection between the electronic component or apparatus and the antenna 1 is obtained without requiring any apertures to be formed through the plastic roof panel 5 because the base member 4 is formed as an integral part of the plastic roof panel 5.

In accordance with another embodiment (not shown) the antenna assembly is the same as that previously described with respect to FIGS. 1A and 1B with the exception that no electronic module 7 is provided between the first and second connection means 6 and 9 so that the first and second connection means 6 and 9 are connected directly together by a single connection comprising at least one conductor.

Figure 2:
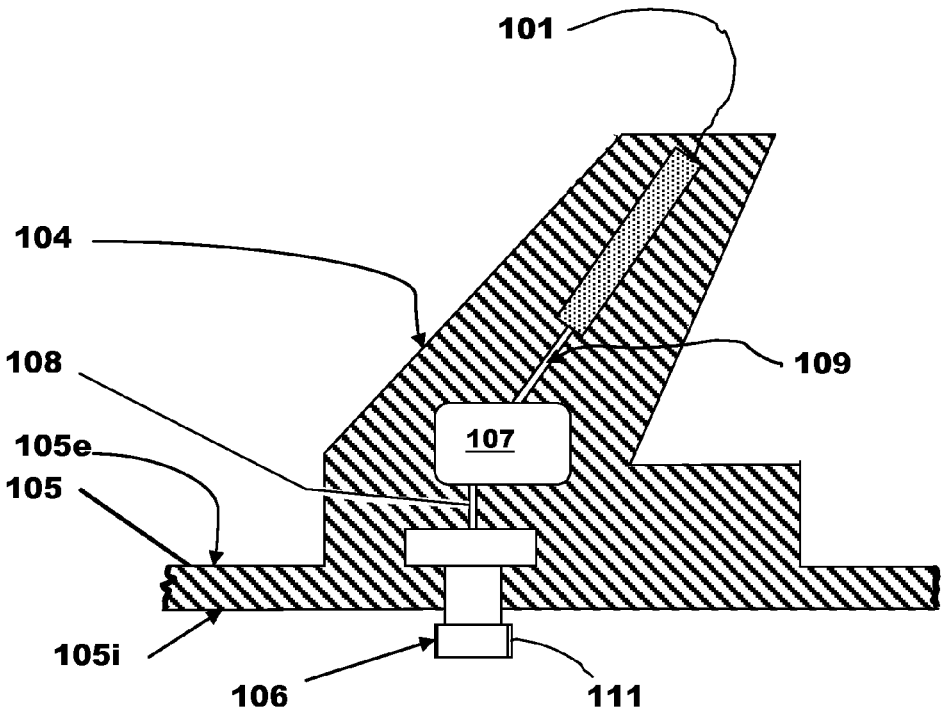
FIG. 2 is a cross-section through a second embodiment of a motor vehicle panel having an integrally formed base member forming part of an antenna assembly.

Referring now to FIG. 2 there is shown a second embodiment of a motor vehicle exterior plastic roof panel 105 according to the invention.

The plastic roof panel 105 has an upper or exterior surface 105*e* and a lower or interior surface 105*i* facing towards a passenger compartment of a motor vehicle of which the plastic body panel 105 forms a part. An interior trim panel (not shown) may overlie the interior surface 105*i* of the plastic roof panel 105 in use.

A support for an antenna 101 is provided in the form of a base member 104 formed as an integral part of the plastic roof panel 105 from the same plastic material as the plastic roof panel 105. The base member 104 includes first and second integral electrical connection means 106 and 109. The antenna assembly comprises the base member 104 the first and second integral electrical connection means 106 and 109 and the antenna 101.

The first electrical connection means is an electrical connector 106 in the form of an integral metal insert having a threaded end portion 111 for connection to an electrical cable forming a part of an electrical circuit of the motor vehicle so as to provide an electrical connection to an electronic component or apparatus requiring use of the antenna 101.

It will be appreciated that the first electrical connector 106 could be of an alternative type and is not limited to a threaded construction, for example, it could be a bayonet or twist lock connector.

The second electrical connection means is an electrical conductor 109 connected at one end to the antenna 101 and an opposite end to an electronic module 107.

The electronic module 107 for the antenna 101 is also formed integrally with the base member 104. The electronic module 107 is in the form of electronic signal processing components such as a filter, or signal processing device used for providing an improved connection between the antenna 101 and the apparatus requiring its use.

It will be appreciated that, if required, thermal insulation could be provided for the electronic module 107.

The first electrical connection means 106 and the electronic module 107 are operatively interconnected via an electrical conductor 108 formed as an integral part of the base member 104. The electrical conductors 108, 109 may include more than one discrete conductor each made from a high conductivity metal. When there are several conductors used then each conductor may be covered with an electrical insulating material to insulate it from the other conductors.

The electrical conductors 108, 109 are overmolded with the plastic forming the base member 104 along with the other components 106, 107 of the base member 104 when the plastic roof panel 105 is formed.

In use, a cable is screwed onto the first connector 106 so as to provide a connection from the antenna 101 to the apparatus requiring use of the antenna 101.

Therefore for both embodiments a connection between the electronic apparatus and the antenna 1, 101 is obtained without requiring any apertures to be formed through the plastic roof panel 105. Furthermore, it is not necessary to attach the base member to the vehicle roof while the roof is in position on the vehicle thereby reducing assembly time and cost.

It will be appreciated that the invention is not limited to the methods of manufacture described herein and that any suitable plastic molding process could be used.

It will be appreciated that the electronic component or apparatus requiring use of an antenna could be a radio, a mobile phone, a satellite navigation device or other mobile device for receiving or transmitting data.

It will be appreciated by those skilled in the art that, although the invention has been described by way of example with reference to one or more embodiments, it is not limited to the disclosed embodiments and that alternative embodiments could be constructed without departing from the scope of the invention as defined by the appended claims.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A motor vehicle antenna assembly comprising:

a roof panel;

a base molded integrally with the panel and having a first electrical connector partially extending through the panel for vehicle cabin connection and a second electrical connector for electrically connecting with an antenna supported by the base; and a signal processing electronic module overmolded into the base and electrically connected to the connectors, wherein the connectors and module are spaced from outer base surfaces for protection.

2. The assembly of claim 1 wherein the second electrical connector is exposed to an exterior of the base and the antenna is detachably mechanically engaged with the second electrical connector.

3. The assembly of claim 1 wherein the antenna is overmolded into the base.

4. A molded plastic motor vehicle roof panel comprising:

a base extending from an exterior surface of the panel and molded integrally with the panel;

a first electrical connector molded integrally with the base adjacent to an interior vehicle cabin surface of the panel for connection with a circuit of the motor vehicle;

a second electrical connector molded integrally with the base and electrically connected with the first electrical connector, and adapted for connection with an antenna; and an electronic module for signal processing molded integrally with the base and electrically connected with the first and second electrical connectors, wherein the electrical connectors and electronic module are positioned within the base and spaced from outer surfaces of the base so as to protect the connectors and module.

5. The roof panel of claim 4 wherein the second electrical connector is exposed to an exterior of the base and is adapted to detachably engage the antenna.

6. The roof panel of claim 4 further comprising an antenna entirely overmolded within the base and connected with the second electrical connector.

7. A motor vehicle antenna assembly comprising:

a base molded integrally with an external plastic roof panel of a vehicle;

a first electrical connector extending through the roof panel and overmolded into the base for connection with a circuit of the vehicle;

a second electrical connector overmolded into the base and connected with the first electrical connector;

an electronic module for performing signal processing overmolded into the base and electrically connected with the first and the second electrical connectors; and an antenna overmolded into the base and electrically connected with the second electrical connector, wherein the electrical connectors and the electronic module are positioned within the base and spaced from outer surfaces of the base so as to protect the connectors and module.

* * * * *